US010881227B1

(12) United States Patent
Green

(10) Patent No.: US 10,881,227 B1
(45) Date of Patent: Jan. 5, 2021

(54) CONTAINER LIDS

(71) Applicant: Kyle D. Green, Orlando, FL (US)

(72) Inventor: Kyle D. Green, Orlando, FL (US)

( * ) Notice: Subject to any disclaimer, the term of this patent is extended or adjusted under 35 U.S.C. 154(b) by 0 days.

(21) Appl. No.: 15/715,792

(22) Filed: Sep. 26, 2017

Related U.S. Application Data

(60) Provisional application No. 62/404,416, filed on Oct. 5, 2016.

(51) Int. Cl.
*F21K 2/06* (2006.01)
*A47G 19/22* (2006.01)

(52) U.S. Cl.
CPC .. *A47G 19/2272* (2013.01); *A47G 2019/2238* (2013.01); *F21K 2/06* (2013.01)

(58) Field of Classification Search
CPC ..... A47G 2019/2238; A47G 2200/08; F21K 2/06; F21K 2/00; F21V 33/0004; F21V 33/0024; F21V 33/0036; F21V 33/008
USPC ..... 362/101, 154, 155, 562
See application file for complete search history.

(56) References Cited

U.S. PATENT DOCUMENTS 4,615,459 A 10/1986 Clements
5,171,081 A * 12/1992 Pita ..... A47G 19/025 362/101
5,392,949 A 2/1995 McKenna
D437,223 S 2/2001 Coy et al.
6,553,696 B1 * 4/2003 Foster, Sr. ..... A47G 23/0225 362/101
6,874,906 B1 4/2005 Dorney
6,921,179 B2 7/2005 Diak Ghanem
D522,365 S 6/2006 Samuels
7,229,181 B2 6/2007 Diak Ghanem
D670,419 S 11/2012 Fissell
8,662,696 B2 * 3/2014 Lederer ..... B65D 51/248 362/154
2011/0127267 A1 6/2011 Leach

FOREIGN PATENT DOCUMENTS

CA 2846468 9/2014

* cited by examiner

*Primary Examiner* — William J Carter

(74) *Attorney, Agent, or Firm* — Allen Dyer Doppelt & Gilchrist, PA

(57) ABSTRACT

A container lid includes an upper member extending downwardly and transitioning into at least one sidewall. An aperture is formed on the at least one sidewall. At least one ring structure is dimensioned to be attached to a bottom of the sidewall. At least a portion of the ring structure is embedded with fluorescent material which glows in the dark and thus enables the lid container to be seen in a dark or dimly lit area.

11 Claims, 2 Drawing Sheets

CONTAINER LIDS

CROSS-REFERENCE TO RELATED APPLICATION

The present application claims the benefit of U.S. Provisional Patent Application Ser. No. 62/404,416, filed on Oct. 5, 2016, the contents of which are herein incorporated by reference in their entirety.

FIELD OF THE INVENTION

The present invention relates to a lid for a container, and more particularly to lid that incorporates glow-in-the-dark fluorescence.

BACKGROUND OF THE INVENTION

Lids for containers are designed for a variety of applications, including storing solid food, storing liquid in a drinking bottle or storing similar kinds of non-food items. A lid can keep a contained food item fresh and protect liquid from leaking. It is generally difficult, however, to access a specific container and its associated lid in the dark or a dimly lit area. It would be useful to be able to provide a lid for a container that addresses such deficiencies.

SUMMARY OF THE INVENTION

In view of the foregoing, an object of the present invention is to provide an improved container lid and method of making and using the same. According to one embodiment of the present invention, a container lid includes an upper member extending downwardly and transitioning into at least one sidewall. An aperture is formed on the at least one sidewall. At least one ring structure is dimensioned to be attached to a bottom of the sidewall. At least a portion of the ring structure is embedded with fluorescent material.

According to another embodiment of the present invention, a container lid includes an upper member extending downwardly and transitioning into at least one sidewall. An opening is formed on the at least one sidewall. At least one ring structure is dimensioned to be attached to at least one of the upper member and the sidewall. At least a portion of the ring structure is embedded with fluorescent material.

These and other objects, aspects and advantages of the present invention will be better appreciated in view of the drawings and following detailed description of preferred embodiments.

DETAILED DESCRIPTION OF A PREFERRED EMBODIMENT

Figure 1:
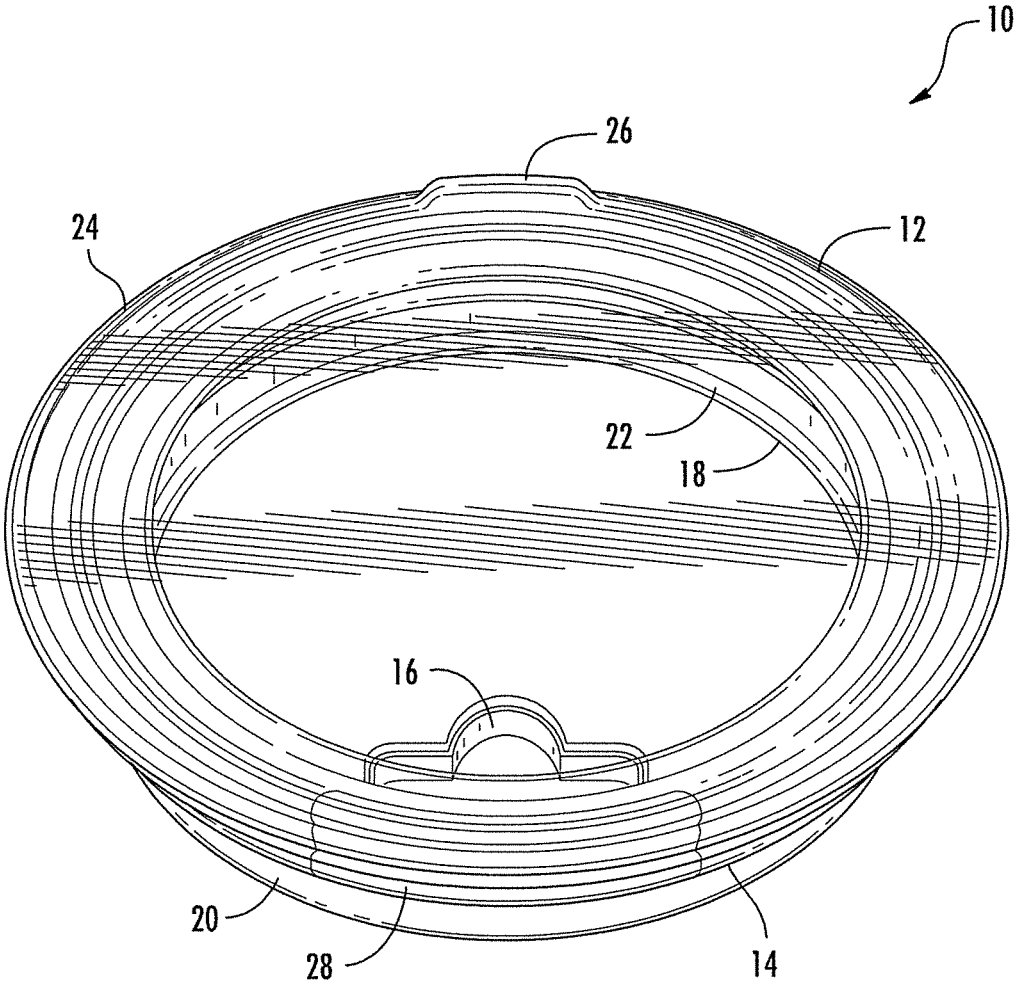
FIG. 1 is a top perspective view of an container lid according to one embodiment of the present invention.
Figure 2:
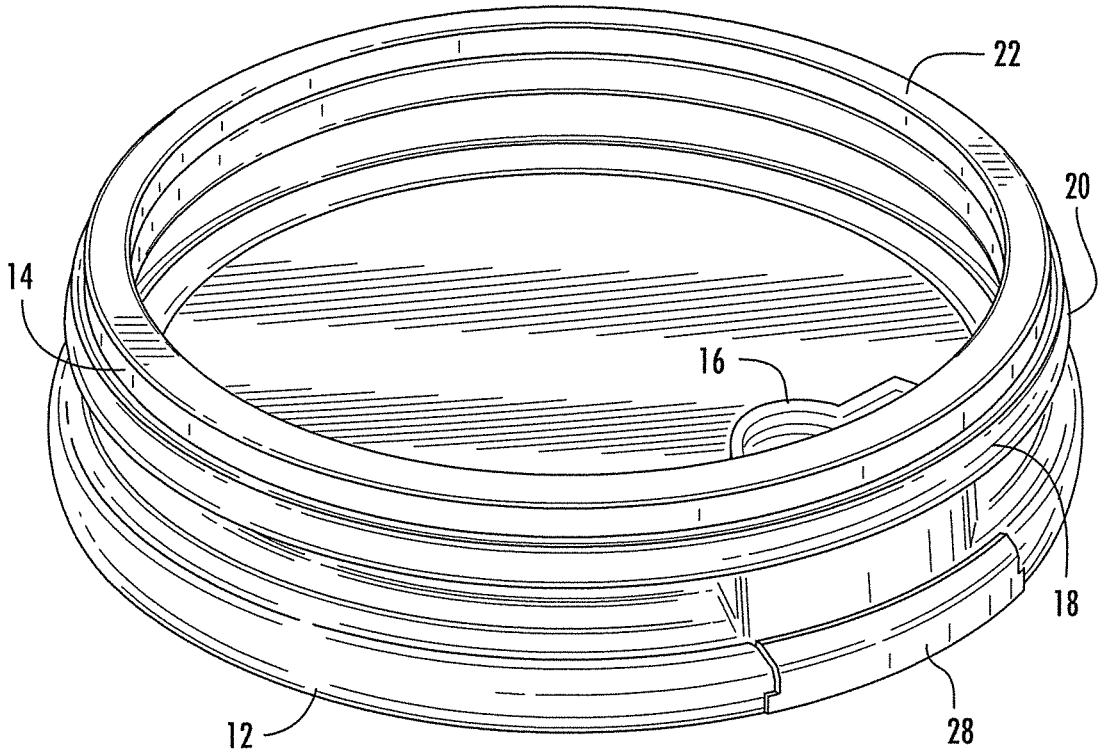
FIG. 2 is a top perspective view of the container lid of FIG. 1 in an inverted position.

Referring to FIGS. 1-2, according to an embodiment of the present invention, a container lid 10 includes an upper member 12 that extends downwardly and transitions into at least one sidewall 14. An opening 16 is formed on the at least one sidewall 14 for drinking or otherwise accessing the content of a container on which the lid 10 covers. The opening 16 can be of different shapes and sizes based on the application. The opening 16 can extend to the upper member 12. In the depicted embodiment, the opening 16 includes a first aperture portion on the at least one sidewall 14 and a second aperture portion on the upper member 12 configure to receive a drinking straw or access content inside the container on which the lid 10 covers. The sidewall 14 can be dimensioned to be slightly smaller than the mouth of the container on which the lid 10 covers, so that it lies closely adjacent to and inside of the container mouth when the lid 10 covers the container. Other arrangement can also be used. For example, the sidewall 14 can also be dimensioned to be slightly bigger than the mouth of the container on which the lid 10 covers.

The lid 10 further comprises at least one ring structure 18 dimensioned to be attached to the bottom of the sidewall 14. At least a portion of the ring structure 18 is embedded with fluorescent material or other suitable material which glows in the dark and thus enables the lid 10 container to be seen in a dark or dimly lit area. For example, the lid 10 can be a translucent plastic tube filled with certain fluorescent additives as a self-contained light source. The fluorescent additives includes chemicals and suitable dyes or fluorophores.

In the depicted embodiment, the at least one ring structure 18 has an upper ring 20 attached directed to the bottom perimeter of the sidewall 14 and lower ring 22 attached directly to the upper ring 20. The upper ring 20 is made of an elastic material such as rubber or another suitable material and the lower ring 22 is made of polymer or other suitable material embedded with fluorescent material or other suitable materials. In the depicted embodiment, the upper ring 20 has slightly larger perimeter than the lower ring 22 in order to snugly fit within the mouth of a corresponding container to provide a tight sealing of the container. The fluorescent material in the lower ring 22 can be any color or a combination of colors as desired. For example, a specific florescent color can be used to indicate cup contents (e.g., food, non-food, solid, liquid, etc.) or cup owners. The at least one ring structure 18 is generally of uniform thickness. The ring structure 18 can be circular or other suitable shapes to match the periphery of the sidewall 14.

The ring structure 18 can also be attached to the upper member 12 and/or inner surface of the sidewall 14. For example, the ring structure 18 can be attached to a bottom surface of the upper member 12. The ring structure 18 can also be attached to an inner side of the sidewall 14 rather than bottom of the sidewall 14. At least a portion of the upper member 12 and/or sidewall 14 is made of transparent or translucent material such as glass, plastic or other suitable polymers. As such, the ring structure 18 embedded with florescent material can be easily viewed in a dark or dim environment.

In the depicted embodiment, the upper member 12 has a skirt 24 about its periphery for a user to easily grip the lid 10 and open/close the lid 10. The skirt 20 also includes an easy gripping area 26. The skirt 24 can include a fluorescent portion 28 that can be in align with the lid opening 16 to indicate the position of the opening 16, such that the opening 16 can be easily viewed in a dark or dim environment. In one embodiment, pictures and/or text may be printed on, embossed in, or otherwise attached to interior or exterior surfaces of the upper member 12.

The lid 10 can be used for driving at night or in a dimly lit environment restaurant, bar, club, bedroom, car, and the like. A user can drink or access the container contents (e.g., coffee, juice) to avoid spillage on furniture, bed sheets, car interior, clothes, and the like. The lid 10 is especially suitable for users to operate at night, such as travelers, commuters, construction workers and other night workers. As no external light is needed, the fluorescent lid can also save energy and energy expense.

The lid 10 can come in different shapes and colors. In the depicted embodiment, the circular lid is about ¼ inches in height and 4 inches in diameter for a 30 ounce container. The lids 10 can be designed to be compliant with and accommodate a broad range of house-hold containers of any shaped and sized container. It is to be understood that the overall design of the lid shown is merely exemplary of the type of lids in which this invention may be embodied. The Lid 10 can be configured in a range of sizes and shapes to meet a wide range of storage applications, such as cups, canned foods, condiment containers, and jars. The configuration and design of the lid 10 and the manner in which the lid 10 seals about the opening of the container can be different from what is depicted.

The lid 10 is dishwasher safe, can withstand microwave or freezer temperatures, and is constructed with components that are considered safe for direct contact with foods. The lid 10 can be made of conventional and readily available process such as injection molding, compression molding, blow molding, rotary molding, and the like. The manufacturing method will depend on the method of choice that best fits the production characteristics such as cost, utility, features and the like.

The foregoing is provided for illustrative and exemplary purposes; the present invention is not necessarily limited thereto. Rather, those skilled in the art will appreciate that various modifications, as well as adaptations to particular circumstances, are possible within the scope of the invention as herein shown and described.

What is claimed is:

1. A container lid comprising:

an upper member having, relative to an intended orientation when the container lid is placed on a container, a top surface and a bottom surface;

a sidewall extending downwardly from the bottom surface of the upper member from a top joining the bottom surface to a bottom spaced apart therefrom;

an opening formed extending through the top and bottom surfaces of the upper member adjacent to, and radially inward of the top of the sidewall; and at least one ring structure attached to the bottom of the sidewall, wherein at least a portion of the ring structure is embedded with fluorescent material;

wherein the upper member has a skirt about its entire periphery extending radially beyond the sidewall such that a radial outer edge of the bottom surface of the upper member is located radially outward of the top of the sidewall and a portion of the radial outer edge forms a radial outer boundary of the opening;

wherein all of the sidewall and of the upper member including the skirt are formed as a solid, co-molded transparent piece, such that illumination from the fluorescent material of the at least one ring structure remains visible through the upper member with the container lid placed on the container; and wherein a fluorescent portion is located on the radial outer edge of the bottom surface of the upper member at the portion forming the radial outer boundary of the opening such that illumination from the fluorescent portion is also visible through the upper member with the container lid placed on the container and the opening is easily viewed in a dark environment.

2. The container lid of claim 1, wherein the opening extends to the upper member.

3. The container lid of claim 1, wherein the opening includes a first aperture portion on the at least one sidewall for drinking directly from the container and a second aperture opening on the upper member for receiving a drinking straw.

4. The container lid of claim 1, wherein at least one ring structure includes an upper ring and a lower ring, wherein the upper ring is made of an elastic material and the lower ring is made polymer embedded with fluorescent material.

5. The container lid of claim 1, wherein the fluorescent material has a specific color.

6. The container lid of claim 1, wherein the fluorescent material has a plurality of colors.

7. The container lid of claim 1, wherein the skirt further includes a gripping area.

8. The container lid of claim 1, wherein at least one of a picture and a text is attached to a surface of the upper member.

9. The container lid of claim 8, wherein the at least one of the picture and text is printed on or embossed in the interior or exterior surfaces of upper member.

10. The container lid of claim 1, wherein the lid is round shaped.

11. The container lid of claim 1, wherein the sidewall is dimensioned to be slightly smaller than a mouth of a container on which the lid covers.

* * * * *